US005439554A

United States Patent [19]

Tamura et al.

[11] Patent Number: 5,439,554

[45] Date of Patent: Aug. 8, 1995

[54] LIQUID JET RECORDING HEAD FABRICATION METHOD

[75] Inventors: Hideo Tamura, Nagahama; Keiichi Murakami, Hachioji, both of Japan

[73] Assignee: Canon Kabushiki Kaisha, Tokyo, Japan

[21] Appl. No.: 73,388

[22] Filed: Jun. 9, 1993

[30] Foreign Application Priority Data

Jun. 10, 1992 [JP] Japan ..... 4-150667

[51] Int. Cl.[6] ..... B44C 1/22; C23F 1/02

[52] U.S. Cl. ..... 216;16; 216/99; 216/48; 346/140.1

[58] Field of Search ..... 156/628, 633, 634, 643, 156/655, 656, 659.1, 644; 346/1.1, 76, 140 R

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1982 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,211,806 | 5/1993 | Wong et al. | 156/644 |

FOREIGN PATENT DOCUMENTS

| | | |
|---|---|---|
| 54-56847 | 5/1979 | Japan . |
| 54-59936 | 5/1979 | Japan . |
| 59-123670 | 7/1984 | Japan . |
| 59-138461 | 8/1984 | Japan . |
| 60-71260 | 4/1985 | Japan . |
| 60-234850 | 11/1985 | Japan . |
| 62-45237 | 2/1987 | Japan . |
| 62-45283 | 2/1987 | Japan . |
| 62-45286 | 2/1987 | Japan . |

*Primary Examiner*—William Powell

*Attorney, Agent, or Firm*—Fitzpatrick, Cella, Harper & Scinto

[57] ABSTRACT

There is disclosed a method for fabricating a liquid jet recording head having heat acting portions, communicating to orifices for liquid discharge, for applying heat energy to a liquid to form a bubble therein, electricity-heat converters for generating said heat energy, pairs of electrodes, and an upper protective layer, characterized in that the wet etching rate of electrode layer is higher on the upper portion in a direction of film thickness than on the lower portion.

5 Claims, 5 Drawing Sheets

LIQUID JET RECORDING HEAD FABRICATION METHOD

BACKGROUND OF THE INVENTION

1. Field of the Invention

The present invention relates to a liquid jet recording head for recording onto a recording medium by discharging liquid (ink) droplets through discharge orifices, and particularly to a method for fabricating the liquid jet recording head having tapered electrode ends.

2. Related Background Art

Of a variety of well known recording methods at present, a so-called liquid jet recording method (ink jet recording method) is significantly effective because it is a non-impact recording method which produces less noise during the recording, has the high speed of recording, and requires no special fixing treatment on ordinary papers for recording.

The liquid jet recording method relies on jetting fine droplets of recording liquid referred to as the ink with various operation principles to attach onto the recording medium such as a paper, and its basic principle has been proposed in Japanese Laid-open Patent Application No. 52-118798 and will be outlined below. That is, this liquid jet recording method is one in which heat pulses as information signal are applied to the recording liquid within an operation chamber having recording liquid introduced therein, and in accordance with an operation force produced by the recording liquid developing into vapor bubbles, the recording liquid is discharged through discharge orifices communicating to the operation chamber, so that fine liquid droplets are jetted and then fixed onto the recording medium.

By the way, in forming heat energy generating means of a liquid jet recording head for use with such liquid jet recording method, it is common practice that a heat generating resistive layer is formed on a desired substrate, and then electrodes and a protective layer are laminated sequentially, wherein it is required that such protective layer of heat energy generating means may cover uniformly necessary portions of the heat generating resistive layer as well as the electrodes, without having any defects such as pinholes, to be able to sufficiently perform various functions as the protective layer, including prevention of breakage of heat generating resistive layer or short-circuit between electrodes.

As previously described, however, the electrodes are typically formed on the heat generating resistive layer, so that a step is produced between the electrodes and the heat generating resistive layer, but this step may yield uneven layer thickness. Hence, it is necessary, on this step portion, that layer formation enough to cover the step (step coverage) must be carried out to prevent any exposed portions from arising due to defects such as pinholes. That is, there were cases where in the insufficient step coverage state, the exposed portion of the heat generating resistive layer may be placed into direct contact with the recording liquid to electrically decompose the recording liquid or break the heat generating resistive layer due to reaction of material of the heat generating resistive layer with the recording liquid. Also, in such step portion, uneven film quality may likely occur, and possibly bring about partial concentration of heat stress developed in the protective layer due to repetitive heat generation, causing cracks on the protective layer, in which there were cases where recording liquid might penetrate through cracks to lead to breakage of the heat generating resistive layer as mentioned above. Further, the recording liquid may enter through pinholes to break down the heat generating resistive layer.

Conventionally, to resolve such a problem, it is common practice to increase the thickness of the protective layer to improve the step coverage or reduce pinholes. However, the greater thickness of the protective layer may contribute to the step coverage or reduction of pinholes, but may impede the heat supply to the recording liquid, resulting in a new problem as described below.

That is, the heat generated in the heat generating resistive layer will transfer through the protective layer to the recording liquid, wherein the heat resistance between the protective layer to apply the heat and the heat generating resistive layer will increase with greater thickness of the protective layer, requiring more electric load than necessary to be applied on the heat generating resistive layer, so that the following problems may be encountered:

1. Inefficient power saving.
2. More heat than necessary stored in substrate, with poorer heat responsibility.
3. Reduced durability of heat generating resistive layer due to greater power supply than necessary.

Such problems can be overcome by reducing the thickness of protective layer, but in a conventional fabrication method for liquid jet recording heads which uses the film formation method such as sputtering or vapor deposition for forming the protective layer, there was a drawback in the respect of durability as previously described, due to false step coverage, so that it was difficult to reduce the thickness of the protective layer.

In recording with the liquid jet recording head as above described, it is typically well known that the stability in bubbling the recording liquid can be improved by rapid heating of the recording liquid. That is, the electric signal to be applied to heat energy generating means, typically in the form of rectangular suspend pulses, has a property that the shorter the pulse width, the more excellent the bubbling stability of recording liquid, which can improve discharge stability of fine liquid droplets and recording qualities. However, the conventional liquid jet recording head is required to increase the layer thickness of the protective layer as previously described, which will also increase the heat resistance of the protective layer, thereby giving rise to a need of generating more heat than necessary in heat energy generating means, resulting in less durability and reduced heat responsibility. Therefore, it is difficult to shorten the pulse width, essentially resulting in a limitation in improving the recording quality.

Accordingly, a propose has been made in which the film thickness of a protective layer is reduced without any adverse effects on step coverage. For example, Japanese Laid-open Patent Application No. 60-234850 has proposed a bias sputter exhibiting excellent step coverage as a film forming method of the protective layer, Japanese Laid-open Patent Application Nos. 62-45283 and 62-45237 have proposed to improve step coverage by changing the shape of step by etchback or sputter etch after forming the protective layer, and Japanese Laid-Open Patent Application No. 62-45286 has proposed to improve step coverage by reflowing the protective layer.

However, the bias sputter has a drawback that the stability of film thickness is inferior and dirts may be produced around target. Also, the methods of etchback, sputter etch, and reflow may increase the number of processes, thereby raising up the costs.

Other methods include making a tapered cross-sectional shape of electrode to improve the step coverage of protective film, as proposed in HP journal, May, 1985. Also, it has been proposed to make a tapered shape of electrode by using a developer which is an alkali solution, and etching the resist together with electrodes (U.S. patent application No. 871,188, filed on Apr. 20, 1992 to the common assignee). The tapered cross-sectional shape of electrode is significantly effective means to improve the step coverage without increasing the film thickness of protective film, wherein its effects may greatly change with taper shape.

That is, when the taper is steep, the step coverage is insufficient, giving rise to a previously described problem. On the other hand, when the taper is gentle, the electrode wiring is reduced in width and cross section to produce higher resistance than other portions to have a dispersion of wiring resistance within the liquid jet recording head, resulting in a problem that the print quality of recording apparatus may be adversely affected.

In order to control the taper shape, the above-described method controls the concentration and temperature of developer, but due to instability of the etching rate for electrode and resist, there occurred some dispersion in taper shape, particularly when the taper shape became gentle. This dispersion of taper shape has led to dispersion of resistance value, whereby the print quality may degrade particularly for larger substrates.

SUMMARY OF THE INVENTION

The present invention has been achieved in the light of the aforementioned problems, and its object is to provide a method for fabricating a liquid jet recording head which can provide sufficient step coverage of an electrode layer, without increasing the thickness of a protective layer.

More specifically, it is an object of the invention to provide a method for fabricating a liquid jet recording head in which an electrode layer is etched to form an electrode having even and gentle ross sectional taper shape.

It is another object of the present invention to provide a method for fabricating a liquid jet recording head having heat acting portions, communicating to orifices or discharge ports for liquid discharge, for applying heat energy to a liquid to form a bubble therein, electricity-heat converters for generating said heat energy, pairs of electrodes, and an upper protective layer, characterized in that the wet etching rate of electrode layer is higher on the upper portion in a direction of film thickness than on the lower portion.

It is another object of the present invention to provide a liquid jet recording head having heat acting portions, communicating to orifices for liquid discharge, for applying heat energy to a liquid to form a bubble therein, electricity-heat converters for generating said heat energy, pairs of electrodes, and an upper protective layer, characterized in that the end portion of said electrode is tapered, and the etching rate of electrode layer is higher on the upper portion in a direction of film thickness than on the lower portion.

According to the present invention, it is possible to provide a liquid jet recording head with less dispersion in resistance and having high print quality, as the even taper shape can be formed because the instable factors of the etching rate are quite reduced.

Also, since the smooth taper shape can be obtained, it is possible to provide a liquid jet recording head having excellent durability and high reliability.

DETAILED DESCRIPTION OF THE PREFERRED EMBODIMENTS

Figure 1:
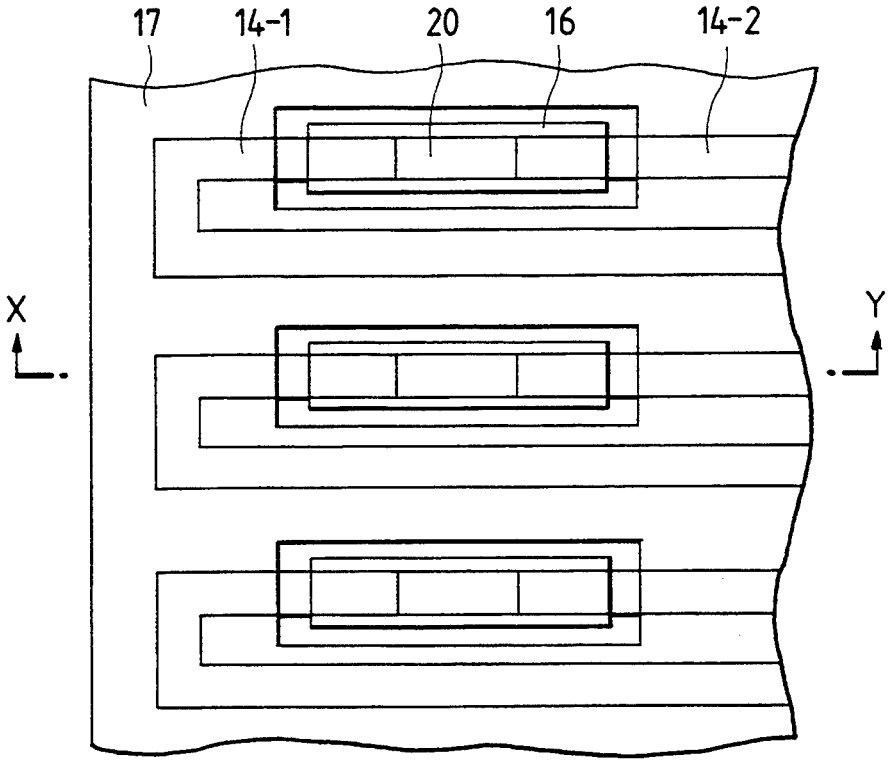
FIG. 1 is a plan view illustrating a portion of a heater board.

The present inventors have adopted the following two methods without any increase in the number of fabrication processes to accomplish the objects of the invention.

The first invention is concerned with a method for fabricating a liquid jet recording head consisting of heat acting portions, communicating to orifices for liquid discharge, for applying heat energy to a liquid to form a bubble therein, electricity-heat converters for generating the heat energy, pairs of electrodes, and an upper protective layer, wherein electrodes having tapered ends are obtained by etching a photoresist on an electrode layer in a width direction thereof, as well as etching the electrode layer, characterized in that the distribution of etching rate on the photoresist falls within ±25% in a substrate of the recording head.

The second invention is concerned with a method for fabricating a liquid jet recording head having heat acting portions, communicating to orifices for liquid discharge, for applying heat energy to a liquid to form a bubble therein, electricity-heat converters for generating the heat energy, pairs of electrodes, and an upper protective layer, wherein electrodes having tapered ends are obtained by etching a photoresist on an electrode layer in a width direction thereof, as well as etching the electrode layer, characterized in that the distribution of etching rate on the photoresist is equal to or less than ±10% in a substrate of the recording head.

In the first invention, the electrode layer is formed as a film by, for example, sputtering, coated with a photoresist thereon, and then subjected to exposure, development and post-bake in a state wherein the temperature distribution within the substrate is preferably within ±7° C., more preferably within ±5° C. Then by etching the photoresist after post-bake in a width direction within the substrate, the dispersion in the etching rate for photoresist can be suppressed to ±25% or less, while at the same time the taper shape of electrode layer to be etched can be made even within the substrate.

The post-bake temperature for photoresist is typically from 100° C. to 140° C.

In the second invention, when forming the electrode layer as a film, by controlling the substrate heating temperature during the film formation to be preferably within ±20° C., more preferably within ±10° C., the dispersion in the etching rate for the electrode layer can be rendered within ±10%, so that it is possible to make an even taper shape within the substrate.

The heating temperature of substrate is typically form 50° C. to 250° C.

There methods have a merit of raising the yield without any increase in the number of processes, but there remains a potentiality of improvement regarding the dispersion in taper shape. This is because the etching rate for resist is more difficult to control than that of electrodes. Further, since for the nozzle density having as many as 800 dpi, the line of electrode and the space therebetween become quite slender to as large as about 15 μm, there was a risk that the reliability of electrode may degrade if the resist and the electrode are etched simultaneously. Thus, the present inventors have led to the following method for controlling the etching rate positively.

The third invention is concerned with a method for fabricating a liquid jet recording head having heat acting portions, communicating to orifices for liquid discharge, for applying heat energy to a liquid to form a bubble therein, electricity-heat converters for generating the heat energy, pairs of electrodes, and an upper protective layer, characterized in that an electrode layer made of a material containing impurities or a homogeneous material is subjected to wet etching in a direction of film thickness at uneven etching rate wherein the etching rate on the upper portion is higher than on the lower portion.

According to this third invention, it is possible to fabricate evenly a desired taper shape by controlling the etching rate of electrode, as it is unnecessary to etch the resist.

In the third invention, in order for the etching rate of electrode layer to be higher on the upper portion than on the lower portion, the content of impurities within the electrode layer is increased continuously or stepwise from upper to lower portion. The material for the electrode layer may be preferably Al, and the impurity contained therein may be Si or Cu. Owing to impurities contained therein, the wet etching rate will decrease. The content of impurities is preferably 5 wt % or less, more preferably 3 wt % or less, from the respects of specific resistance of electrode and workability.

The film formation method for electrode layer will be described with an instance where Si is contained in Al, for example, wherein sputtering is made using Al-Si alloy target on the heat generating resistive layer, and then using pure Al target. From the aspect of productivity, it is preferable that two targets are provided within the same apparatus, but two sputtering apparatuses may be used. Also, to change continuously the content of impurities, a method can be taken of sputtering alternately using two targets of pure Al and Si.

While the material of electrode is preferably Al from the respects of workability and costs as mentioned above, it should be noted that any one of typical electrode materials may be used as long as it can be subjected to dry etching, with the etching rate changing depending on the content of impurities. Also, the film formation methods for electrode layer include a sputtering method, a vapor deposition method, and a CVD method.

Another method for making the wet etching rate of electrode layer higher on the upper portion than on the lower portion is that the film formation method and/or film formation condition is changed stepwise or continuously from the upper to lower portion so that the wet etching rate on the upper portion may be higher than on the lower portion. The above method can be accomplished by, for example, sputtering as the film formation method, and setting a greater discharge power and a higher substrate temperature on the lower portion.

Referring now to the drawings, the present invention will be specifically described below.

Figure 2:
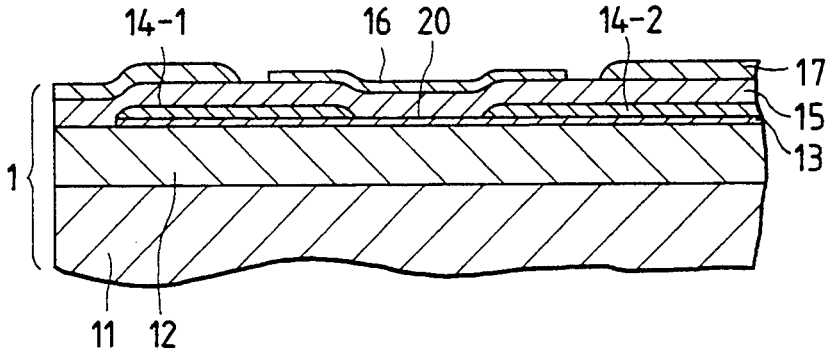
FIG. 2 is a cross-sectional view of FIG. 1, taken along the line X–Y.

FIG. 1 is a plan view illustrating a part of a heater board of the present invention, and FIG. 2 is a cross-sectional view of FIG. 1, taken along the line X–Y.

A lower layer of $SiO_2$ is formed on a substrate carrier 11 made of silicone, by thermal oxidation, for example. Herein, instead of $SiO_2$, $Si_3N_4$ may be used. Then, a heat generating resistive layer 13 of $HfB_2$ is formed thereon as a film, by sputtering, for example. Instead of $HfB_2$, various substances may be used for the heat generating resistive layer.

On the heat generating resistive layer is formed an electrode layer 14 (not shown, a first electrode 14-1 and a second electrode 14-2 are formed by etching). A contact layer made of Ti may be provided between the heat generating resistive layer 13 and the electrode layer 14. The materials for the electrode layer may include a variety of metals as typically used if the metal is able to be subjected to wet etching without damaging the heat generating resistive layer, with the etching rate changing depending on the content of impurities, among which Al is most preferable from the respects of workability and costs. Also, the formation of electrode layer can be performed by any one of sputtering, vapor deposition, and CVD methods.

Figure 3:
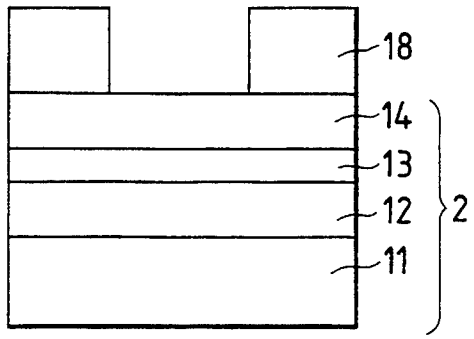
FIG. 3 is a cross-sectional view for explaining the second and third inventions.
Figure 4:
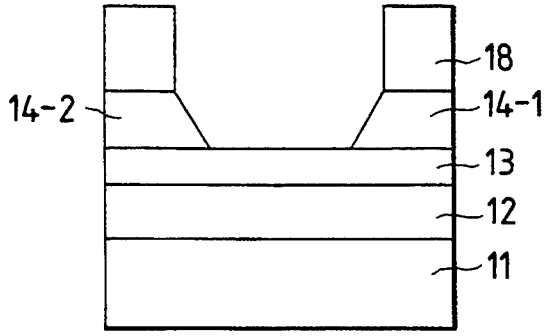
FIG. 4 is a cross-sectional view illustrating the situation of etching an electrode layer in the second and third inventions.
Figure 5:
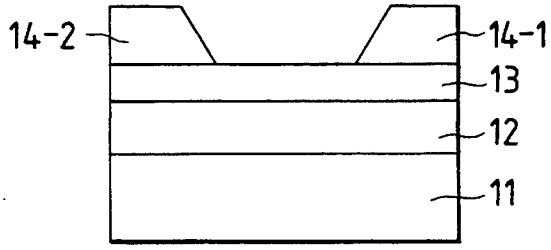
FIG. 5 is a cross-sectional view illustrating the situation of etching an electrode layer in the second and third inventions.

Referring now to FIGS. 3 to 5, the main aspects of the first and second inventions, and a mechanism for making even taper shape of electrode after etching within the substrate, will be described below.

As shown in FIG. 3, on the substrate 11 are formed the lower layer 12, the heat generating resistive layer 13 and the electrode layer 14. In the second invention, when forming the electrode layer 14, the substrate temperature is controlled so that the dispersion of etching rate may fall within 10% in the substrate, as previously described. Then, the electrode layer 14 is coated with a positive-type photoresist 18 for exposure and development. In the first invention, with the temperature distribution within the substrate as previously mentioned, the photoresist is placed in the constant cured condition by post-baking so that the dispersion of etching rate falls within ±25% in the substrate.

Then, in the first and second inventions, by etching the photoresist 18 in a width direction evenly within the substrate, as well as etching the electrode 14, using an alkali solution, the taper shape of the first electrode 14-1 and the second electrode 14-2 formed as shown in FIG. 4 can be made invariable within the substrate. After completion of etching, the photoresist 18 is removed by ashing, so that a base for recording head having electrodes as shown in FIG. 5 can be obtained. On the electrodes 14-1, 14-2 and the heat generating resistive layer 13, a first protective layer, a second protective layer and a third protective layer are provided in such a manner as will be described later with the third invention, whereby a heater board is obtained.

In the third invention, in order to change the wet etching rate by having impurities contained in the electrode layer, an impurity containing Al layer is formed as a film, by sputtering, using a target of an alloy composed of an electrode layer metal and an impurity metal, and then an Al layer is formed by sputtering, using a target of pure Al. Also, it is desirable to provide two targets consisting of a metal for forming the electrode layer and an impurity metal within the same apparatus, from the respect of productivity, but it will be appreciated that two sputtering apparatuses may be used. Also, in order to change continuously the content of impurities in the electrode layer, a method can be taken of alternately sputtering two targets of Al and Si, for example.

As above described, by reducing the content of impurities within the electrode layer in a direction of film thickness from lower to upper portion, the wet etching rate for the electrode layer can be rendered higher on the upper portion than on the lower portion.

Still another means for changing the wet etching rate of the electrode lager as above described involves changing the film formation conditions such as substrate temperature and discharge electric power, for example, when forming the electrode layer by sputtering. For example, by making the discharge power greater on the lower portion than on the upper portion, and/or the substrate temperature on the film formation higher on the lower portion than on the upper portion, when making the film formation by sputtering, the wet etching rate can be changed continuously or stepwise to be higher on the upper portion than on the lower portion.

The electrode layer 14 thus formed is coated with a photoresist as a layer, which is then subjected to exposure, development and post-bake by an ordinary useful method. Then, the etching of the electrode Layer is made using an etching solution. Subsequently, the heat generating resistive layer, and a contact layer as necessary, which are likewise formed by photolithography, are etched by reactive etching using $CCl_4$ to form a heat generating resistor.

Then, after the photoresist is peeled off, a first protective layer 15 of $SiO_2$ or $Si_3N_4$ and a second protective layer 16 of Ta are formed into the patterns as shown in FIGS. 1 and 2 by photolithography. Finally, a third protective layer 17 composed of photosensitive polyimide is applied in a pattern shown in FIGS. 1 and 2. Thus, a heater board 1 for liquid jet head can be fabricated.

Figure 6:
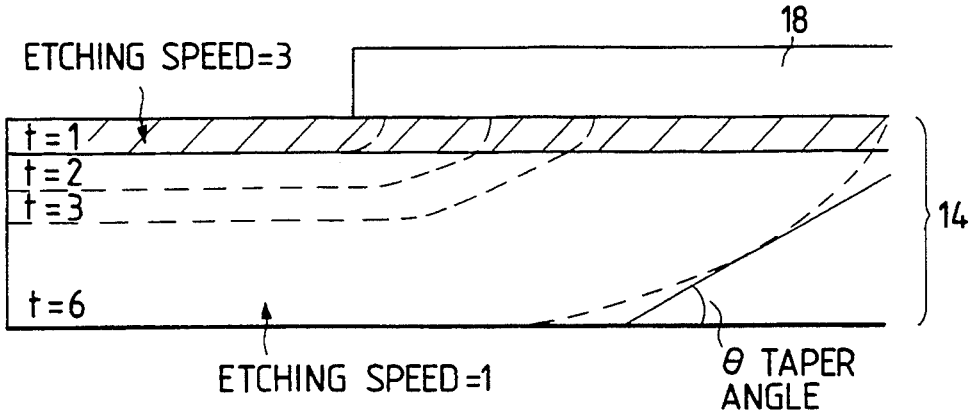
FIG. 6 is a cross-sectional view illustrating a state of etching an electrode layer in the first invention.

Referring now to FIG. 6 which illustrates the etching process in the electrode layer, a mechanism for forming a gentle taper shape of electrode by wet etching of electrode layer in the third invention will be described below.

If the electrode layer is etched in a direction of film thickness at uniform etching rate by conventional wet etching, the etching will progress isotropically, resulting in steep taper shape. With more excessive etching, this taper shape becomes still steeper.

On the contrary, according to the third invention, since the etching rate of electrode layer is higher on the upper portion than on the lower portion (the etching rate on the upper portion being three times that on the lower portion in FIG. 6), when the etching is already performed on the upper portion of the electrode layer and is progressing into the lower portion, the etching will also extend across the transverse direction of the electrode layer on the upper portion, from which the etching will further progress into the lower portion of the electrode layer, so that the taper angle $\theta$ decreases as shown in FIG. 3. Thus, there is no risk that the electrode becomes slender, because it is unnecessary to etch the resist.

FIG. 6 shows two kinds of etching rate on the upper portion and on the lower portion, but it goes without saying that the slope can be provided by changing the etching rate continuously or stepwise from the upper to lower portion.

Figure 7:
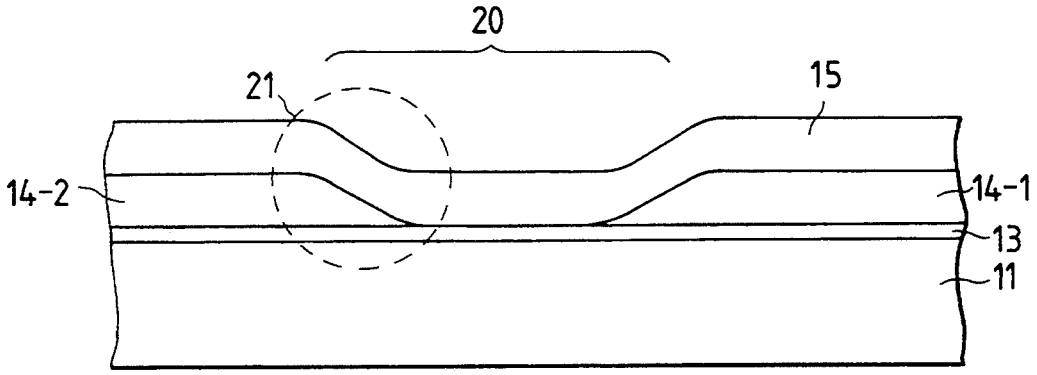
FIG. 7 is an enlarged view around an electrode of FIG. 2.

FIG. 7 illustrates an enlarged view around the electrode, from which it will be clear that a step 21 of electrode is gentle, excellent step coverage being provided by the first protective layer 15 having a uniform thickness.

The first, second and third inventions can be used singly or in an appropriate combination thereof to accomplish the objects of the present invention.

Figure 8:
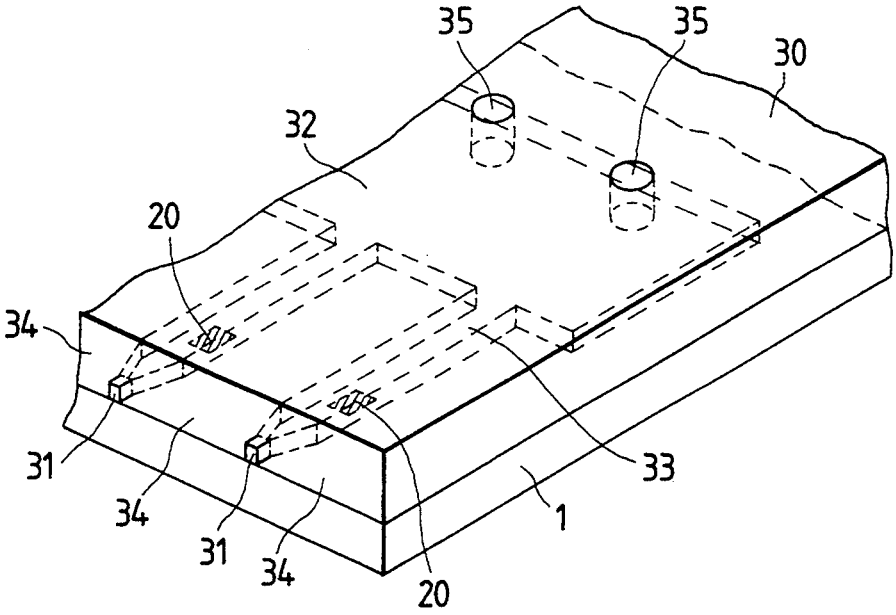
FIG. 8 is a partial perspective view illustrating an example of a full-line recording head according to the present invention.
Figure 10:
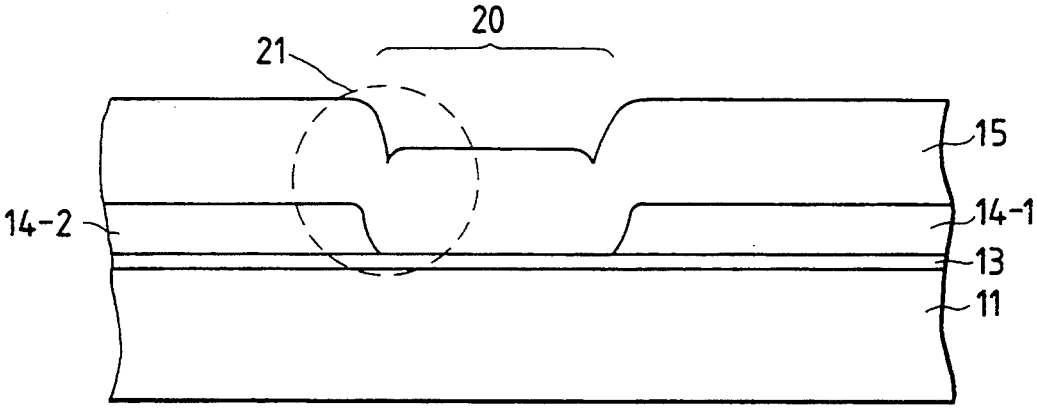
FIG. 10 is an enlarged cross-sectional view around an electrode in a conventional liquid jet recording head.

FIG. 8 is a perspective view illustrating a full-line type liquid jet recording head wherein a plurality of discharge orifices are provided over the entire width of recording area in recording medium, which is exemplary of a liquid jet recording head having an electrode construction of the present invention. The construction of this recording head will be clearly seen from FIG. 8.

Figure 9:
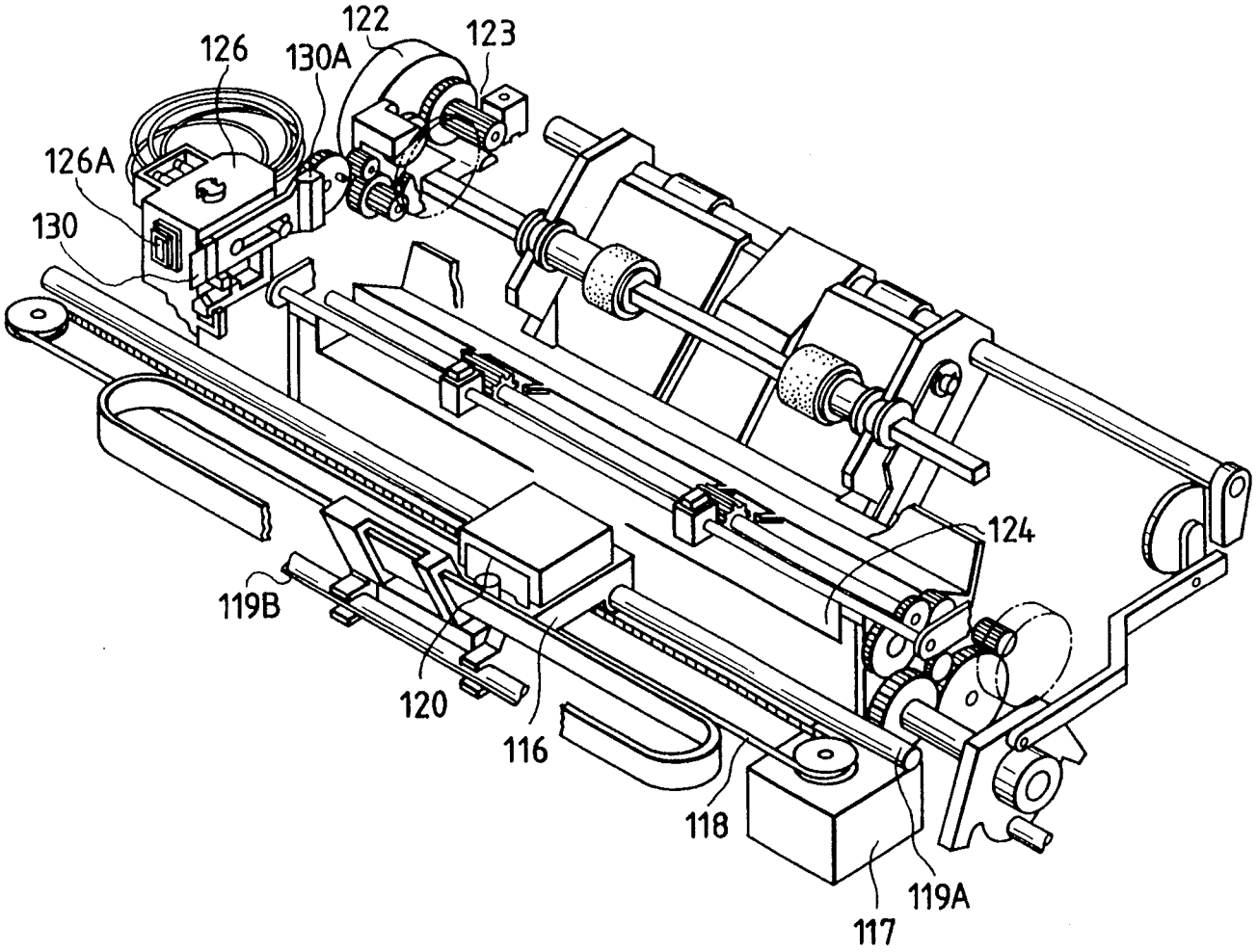
FIG. 9 is a perspective view exemplifying a recording apparatus having a liquid jet recording head according to the present invention.

FIG. 9 is an external perspective view exemplifying an ink jet recording apparatus (IJRA) with a recording head of the present invention mounted as an ink jet head cartridge (IJC).

In the figure, 120 is an ink jet head cartridge (IJC) having a group of nozzles for ink discharge which is placed opposed to the recording plane of a recording sheet supplied on a platen 124. 116 is a carriage HC for holding IJC 120, connecting to part of a drive belt 118 for transmitting the drive force of a drive motor 117, and slidingly mounted on two guide shafts 119A and 119B disposed in parallel to each other, so that the IJC 120 can be reciprocatingly moved over an entire width of recording sheet.

126 is a head recovery device disposed at one end of travel passage of the IJC 120, for example, at a position opposite a home position. The head recovery device 126 is operated by the drive force transmitted via a transmission mechanism 23 from a motor 122 to make a capping for the IJC 120. In the capping of the IJC 120 with a cap portion 126A of the head recovery device 126, a discharge recovery processing is carried out in which the IJC 120 is subjected to ink suction with appropriate suction means provided within the head recovery device 126, or ink force feed with appropriate pressure means provided on an ink supply passage to the IJC 120, thereby compulsorily discharging the ink through discharge orifices to remove thickened ink from within the nozzles. The IJC 120 can be protected by a cap when the recording is finished.

130 is a blade useful as a wiping member which is disposed on the lateral side of the head recovery device 126 and formed of silicone rubber. A blade 131 is held on a blade holding member 131A in a cantilevered form, and operated by the motor 122 and the transmission mechanism 123, like the head recovery device 126, to be engageable on a discharge face of the IJC 120. Thereby, at appropriate timings in the recording operation of the IJC 120, or after the discharge recovery processing using the head recovery device 126, the blade 131 is protruded into the travel passage of the IJC 120, to wipe out dew, wet or dusts on the discharge face of the IJC 120, along with the moving operation of the IJC 120.

EXAMPLES

The present invention will be further specifically described using the examples and comparative examples as presented in the following.

Example 1 and Comparative Example 1

Reference is made to FIGS. 3 to 5, wherein on a substrate made of silicone was first formed a lower layer 12 (heat storing layer) of $SiO_2$ having a thickness of 2 μm by thermal oxidation. Then, a heat generating resistive layer 13 of $HfB_2$ was formed in a thickness of 0.1 μm by sputtering. On the heat generating resistive layer 13, an electrode layer 14 of Al was formed in a thickness of 0.6 μm by sputtering. Also, a contact layer of Ti between the heat generating resistive layer and the electrode layer 14 was formed in a thickness of 0.005 μm by sputtering, whereby a base 2 for recording head could be obtained.

The above-obtained base 2 was coated with a positive-type photoresist 18 (DFPR-800 made by Tokyo Ohka Kogyo) in a thickness of 1.5 μm to make subsequently exposure and development. Then, using a hot plate, the temperature distribution within the substrate was rendered in a range of 120° C.-±5° C. to make post-baking. Subsequently, by etching the positive-type photoresist 18 in a width direction evenly within the substrate, as well as etching the electrode 14, using an alkali solution (NMD-3/2.38% solution made by Tokyo Ohka Kogyo), the electrode was tapered as shown in FIG. 4 so that the taper shape invariable within the substrate could be obtained.

Then, the positive-type photoresist was removed by ashing to form a first electrode 14-1 and a second electrode 14-2 as shown in FIG. 5.

Thereafter, the heat generating resistive layer was patterned by photolithography. And a first protective layer 15 of $SiO_2$ and a second protective layer 16 of Ta were formed in thicknesses of 1.0 μm and 0.5 μm, respectively, by sputtering, and then patterned by photolithography. Finally, a third protective layer 17 was formed by applying a photosensitive polyimide thereon, and then patterned, whereby a heater board could be completed.

As a comparative example 1, a heater board was fabricated in the same way as in example 1, except that the temperature distribution within the substrate for post-baking was made in a range of 120° C.-±10° C.

The step coverage was evaluated for the protective layer on the electrode around the heater of a liquid jet recording head containing a heater board thus obtained. 10 For checking the step coverage property, the heater board was soft etched by immersing the heater board in a bastard hydrofluoric acid (volume ratio of hydrogen fluoride 10 and $NH_4F$ 90) for several seconds, and then observed. In the example 1, the film of step was substantially not etched, exhibiting excellent step coverage property. On the contrary, in the comparative example 1, the film of step was missed at several sites by being etched, resulting in some distribution in step coverage observed.

Then, a discharge durability test for the head was conducted. The test conditions were such that the drive frequency was 3 kHz, the pulse width was 10 μsec, and the drive voltage was 1.2 times the bubbling voltage. And each head was subjected to a 500 bit test up to $1\times10^9$ pulses. The results are listed in Table 1.

TABLE 1

| | Number of disconnection bits at each pulse | | | | |
|---|---|---|---|---|---|
| | $1\times10^7$ | $3\times10^7$ | $5\times10^7$ | $7\times10^7$ | $1\times10^8$ |
| Example 1 | 0 | 0 | 0 | 0 | 0 |
| Comparative example 1 | 1 | 4 | 6 | 9 | 13 |

As listed in Table 1, the example 1 revealed the excellent results without any one bit of disconnection.

On the contrary, the comparative example 1 revealed that the disconnection began from $1\times10^7$ pulses, and breakage took place at the step portion. Accordingly, by controlling the post-bake temperature distribution for the electrode to provide a uniform etching rate distribution, an ink jet recording head having excellent discharge durability could be obtained.

Example 2 and Comparative Example 2

Reference is made to FIGS. 3 to 5, wherein on a substrate made of silicone was first formed a lower layer 12 (heat storing layer) of $SiO_2$ having a thickness of 2 μm by thermal oxidation. Then, a heat generating resistive layer 13 of $HfB_2$ was formed in a thickness of 0.1 μm by sputtering. On the heat generating resistive layer 13, an electrode layer 14 of Al was formed in a thickness of 0.6 μm by sputtering. In this case the substrate temperature was controlled in a range of 200° C. ±10° C. Also, a contact layer of Ti between the heat generating resistive layer and the electrode layer 14 was formed in a thickness of 0.005 μm by sputtering, whereby a base 2 for recording head could be obtained.

The above-obtained base 2 was coated with a positive-type photoresist 18 (DFPR-800 made by Tokyo Ohka Kogyo) in a thickness of 1.5 μm to subsequently make exposure and development. By etching the positive-type photoresist 18 in a width direction evenly within the substrate, as well as etching the electrode 14, using an alkali solution (NMD-3/2.38% solution made by Tokyo Ohka Kogyo), the electrode was tapered as shown in FIG. 4 so that the taper shape invariable within the substrate could be obtained.

Then, the positive-type photoresist was removed by ashing to form a first electrode 14-1 and a second electrode 14-2 as shown in FIG. 5.

Thereafter, the heat generating resistive layer was patterned by photolithography. And a first protective layer 15 of $SiO_2$ and a second protective layer 16 of Ta were formed in thicknesses of 1.0 μm and 0.5 μm, respectively, by sputtering and then patterned by photolithography. Finally, a third protective layer 17 was formed by applying a photosensitive polyimide thereon, and then patterned, whereby a heater board could be completed.

As a comparative example 2, a heater board was fabricated in the same way as in example 2, except that the temperature distribution within the substrate for film formation of electrode was made in a range of 200° C. ±50° C.

The step coverage was evaluated for the protective layer on the electrode around the heater of a liquid jet recording head containing a heater board thus obtained. 10 For seeing the step coverage property, the heater board was soft etched as in the example 1, and then observed. In the example 2, the film of step was substantially not etched, exhibiting excellent step coverage property. On the contrary, in the comparative example 2, the film of step was missed at several sites by being etched, resulting in some distribution of step coverage observed.

Then, a discharge durability test for the head was conducted. The test conditions were such that the drive frequency was 3 kHz, the pulse width was 10 μsec, and the drive voltage was 1.2 times the bubbling voltage. And each head was subjected to a 500 bit test up to $1\times10^9$ pulses. The results are listed in Table 2.

TABLE 2

| | Number of disconnection bits at each pulse | | | | |
|---|---|---|---|---|---|
| | $1\times10^7$ | $3\times10^7$ | $5\times10^7$ | $7\times10^7$ | $1\times10^8$ |
| Example 2 | 0 | 0 | 0 | 0 | 0 |
| Comparative example 2 | 1 | 3 | 6 | 8 | 14 |

As listed in Table 2, the example 2 revealed the excellent results without any one bit of disconnection. On the contrary, the comparative example 2 revealed that the disconnection began from $1\times10^7$ pulses, and breakage took place at the step portion. Accordingly, by controlling the heating temperature distribution of substrate for the film formation of electrode to provide a uniform film quality and an even etching rate distribution for electrode, an ink jet recording head having excellent discharge durability could be obtained.

Examples 3 and 4 and comparative example 3

Reference is made to FIG. 2, wherein on a substrate carrier 11 made of silicone was first formed a lower layer 12 (heat storing layer) of $SiO_2$ having a thickness of 2.0 μm by thermal oxidation. Then, a heat generating resistive layer 13 of $HfB_2$ was formed in a thickness of 0.1 μm by sputtering. Then, an electrode layer 14 of Al was formed in a thickness of 0.6 μm under the film formation conditions as listed in Table 4, in the examples 3, 4 and the comparative example 3. In this condition, the wet etching rate was higher on the upper Al (second stage) than on the lower Al (first stage). The Al etching rate on the upper portion was two or three times that on the lower portion in the example 3, and about 2.6 times in the example 4, the etching rate being higher on the upper portion.

Note that a contact layer of Ti was formed between $HfB_2$ and Al in a thickness of 50 angstroms by sputtering.

TABLE 3

| | Electrode film forming conditions (Total thickness of electrode layer 6000 angstroms) | | | | Taper angle |
|---|---|---|---|---|---|
| | 1st stage sputter | | 2nd stage sputter | | |
| Ex. 3 | Ar gas pressure | 10 mTorr | Ar gas pressure | 10 mTorr | 33° |
| | Discharge power | 1.5 KW | Discharge power | 1.5 KW | |
| | Substrate heating temperature | 300° C. | Substrate heating temperature | 200° C. | |
| | Al—Si(Si2 wt %) (Al—Si alloy) | 5000 angstroms | Al film thickness | 1000 angstroms | |
| | | | Etching rate of Al | 2.3 times that of Al—Si alloy at 1st stage | |
| | 1st stage sputter | | 2nd stage sputter | | |
| Ex. 4 | Ar gas pressure | 10 mTorr | Ar gas pressure | 10 mTorr | 31° |
| | Discharge power | 1.5 KW | Discharge power | 1.5 KW | |
| | Substrate heating temperature | 300° C. | Substrate heating temperature | 200° C. | |
| | Al—Cu(Cu2 wt %) (Al—Cu alloy) | 5000 angstroms | Al film thickness | 1000 angstroms | |
| | | | Etching rate of Al | 2.6 times that of Al—Cu alloy at 1st stage | |
| | Sputter | | | | |
| Comp. ex. 3 | Ar gas pressure | 10 mTorr | | | 70° |
| | Discharge power | 1.5 KW | | | |
| | Substrate heating temperature | 300° C. | | | |
| | Al film thickness | 6000 angstroms | | | |

Subsequently, the Al layer was patterned by photolithography as follows. First, a photoresist (trade name: DFPR-800, made by Tokyo Ohka Kogyo) was applied as a layer (layer thickness: 1.3 μm) on the Al layer, and then subjected to exposure, development and baking by the ordinary method. Then, Al layer was etched at a liquid temperature of 40° C. under 10% over-etch conditions, using an etching solution which was mixture solution of acetic acid, phosphoric acid and nitric acid (acetic acid 9 wt %, phosphoric acid 73 wt %, nitric acid 2 wt %, remaining 16 wt %).

As a result, the taper angle of Al electrode in the cross section is shown in Table 4.

$HfB_2$ layer and Ti layer, patterned likewise by photolithography, were subjected to reactive etching using $CCl_4$ to form a heat generating resistor. Its dimension was as large as 30 μm×150 μm.

After the photoresist was peeled off, a first protective layer 15 of $SiO_2$ and a second protective layer 16 of Ta were formed in thickness of 1.0 μm and 0.5 μm, respectively, by sputtering, and then patterned by photolithography as shown in FIGS. 1 and 2. Finally, a third protective layer 17 was formed by applying a photosensitive polyimide thereon, and then patterned as shown in FIGS. 1 and 2, whereby a heater board for liquid jet recording head could be completed.

The step coverage was evaluated for the protective film on the electrode around the heater of a liquid jet recording head containing a heater board thus obtained.

To observe the film quality of step portion, soft etching was conducted as in the example 1.

In the examples 3 and 4, the film of step was substantially not etched, exhibiting excellent step film quality. On the contrary, in the comparative example 3, the film of step was missed at several sites by being etched, resulting in poor film quality at step portion.

A print durability test was conducted using a recording head fabricated by joining the heater board 1 as above obtained with a ceiling plate 30 (see FIG. 8). The test conditions were such that the drive frequency was 3 kHz, the pulse width was 10 μsec, and the drive voltage was 1.2 times the bubbling voltage. And each head was subjected to a 500 bit test up to $1\times10^8$ pulses. The results are listed in Table 4.

TABLE 4

| | Number of disconnection bits at each pulse | | | | |
|---|---|---|---|---|---|
| | $1\times10^7$ | $3\times10^7$ | $5\times10^7$ | $7\times10^7$ | $1\times10^8$ |
| Example 3 | 0 | 0 | 0 | 0 | 0 |
| Example 4 | 0 | 0 | 0 | 0 | 0 |
| Comparative example 3 | 0 | 14 | 47 | 113 | 241 |

As listed in Table 4, the examples 3 and 4 revealed the excellent results without any one bit of disconnection. On the contrary, the comparative example 3 revealed that the disconnection began from $3\times10^7$ pulses, and reached 50% at $1\times10^8$ pulses.

Accordingly, according to the present invention, due to a gentle taper formation at electrode step portion, and an improved step coverage with the protective film, an ink jet recording head having excellent durability could be obtained.

Examples 5 and 6 and Comparative Example 4

Reference is made to FIG. 2, wherein on a substrate carrier 11 made of silicone was first formed a lower layer 12 (heat storing layer) of $SiO_2$ having a thickness of 2.0 μm by thermal oxidation. Then, a heat generating resistive layer 13 of $HfB_2$ was formed in a thickness of 0.1 μm by sputtering. Then, an electrode layer 14 of Al was formed in a thickness of 0.6 μm under the film formation conditions as listed in Table 5, in the examples 5, 6 and the comparative example 4. In this condition, the wet etching rate was higher on the upper Al (second stage) than on the lower Al (first stage). The Al etching rate on the upper portion was two times that on the lower portion in the example 5, and three times that on the lower portion in the example 6.

Note that a contact layer of Ti was formed between $HfB_2$ and Al in a thickness of 50 angstroms by sputtering.

TABLE 5

| | Electrode film forming conditions (Total thickness of electrode layer 6000 angstroms) | | | | Taper angle |
|---|---|---|---|---|---|
| | 1st stage sputter | | 2nd stage sputter | | |
| Ex. 5 | Ar gas pressure | 10 mTorr | Ar gas pressure | 10 mTorr | 35° |
| | Discharge power | 1.5 KW | Discharge power | 1.0 KW | |
| | Substrate heating temperature | 300° C. | Substrate heating temperature | No heating | |
| | Al film thickness | 5000 angstroms | Al film thickness | 1000 angstroms | |
| | | | Etching rate of Al | 2.1 times that of Al at 1st stage | |
| | 1st stage sputter | | 2nd stage Electronic beam deposition | | |
| Ex. 6 | Ar gas pressure | 10 mTorr | Base pressure | $1\times10^{-6}$ Torr | 30° |
| | Discharge power | 1.5 KW | Substrate heating temperature | No heating | |
| | Substrate heating temperature | 300° C. | Etching rate of Al | 2.9 times that of Al at 1st stage | |
| | Al film thickness | 5000 angstroms | | | |
| | Sputter | | | | |
| Comp. ex. 4 | Al gas pressure | 10 mTorr | | | |
| | Discharge power | 1.5 KW | | | |
| | Substrate heating temperature | 300° C. | | | |
| | Al film thickness | 6000 angstroms | | | |

Subsequently, the Al layer was patterned by photolithography as follows. First, a photoresist (trade name: DFPR-800, made by Tokyo Ohka Kogyo ) was applied as a layer (layer thickness: 1.3 μm) on the Al layer, and then subjected to exposure, development and baking by the ordinary method. Then, Al layer was etched at a liquid temperature of 40° C. under 10% over-etch conditions, using an etching solution which was a mixture solution of acetic acid, phosphoric acid and nitric acid (acetic acid 9 wt %, phosphoric acid 73 wt %, nitric acid 2 wt %, remaining 16 wt %).

As a result, the taper angle of Al electrode in the cross section is shown in Table 5.

$HfB_2$ layer and Ti layer, patterned likewise by photolithography, were subjected to reactive etching using $CCl_4$ to form a heat generating resistor. Its dimension was as large as 30 μm×150 μm.

After the photoresist was peeled off, a first protective layer 15 of $SiO_2$ and a second protective layer 16 of Ta were formed in thicknesses of 1.0 μm and 0.5 μm, respectively, by sputtering, and then patterned by photolithography as shown in FIGS. 1 and 2. Finally, a third protective layer 17 was formed by applying a photosensitive polyimide thereon, and then patterned as shown in FIGS. 1 and 2, whereby a heater board for liquid jet recording head could be completed.

The step coverage was evaluated for the protective film on the electrode around the heater of a liquid jet recording head containing-a heater board thus obtained.

To observe the film quality of step portion, soft etching was conducted.

In the examples 5 and 6, the film of step was almost not etched, exhibiting excellent step film quality. On the contrary, in the comparative example 4, the film of step was missed at several sites by being etched, resulting in poor film quality at step portion.

A print durability test was conducted using a recording head fabricated by jointing the heater board 1 as above obtained with a ceiling plate 30 (see FIG. 8). The test conditions were such that the drive frequency was 3 kHz, the pulse width was 10 μsec, and the drive voltage was 1.2 times the bubbling voltage. And each head was subjected to a 500 bit test up to $1\times10^8$ pulses. The results are listed in Table 6.

TABLE 6

| | Number of disconnection bits at each pulse | | | | |
|---|---|---|---|---|---|
| | $1\times10^7$ | $3\times10^7$ | $5\times10^7$ | $7\times10^7$ | $1\times10^8$ |
| Example 5 | 0 | 0 | 0 | 0 | 0 |
| Example 6 | 0 | 0 | 0 | 0 | 0 |
| Comparative example 4 | 0 | 14 | 47 | 113 | 241 |

As listed in Table 6, the examples 5 and 6 revealed the excellent results without any one bit of disconnection. On the contrary, the comparative example 4 revealed that the disconnection began from $3\times10^7$ pulses, and reached 50% at $1\times10^8$ pulses.

Accordingly, according to the present invention, due to a gentle taper formation at electrode step portion, and an improved step coverage with the protective film, an ink jet recording head having excellent durability could be obtained.

The present invention brings about excellent effects particularly in a recording head or a recording device on the ink jet recording system for performing the recording by forming fine liquid droplets by the use of heat energy among the various ink jet recording systems.

As to its representative constitution and principle, for example, one practiced by use of the basic principle disclosed in, for example, U.S. Pat. Nos. 4,723,129 and U.S. Pat. No. 4,740,796 is preferred. This system is applicable to either of the so-called on-demand type and the continuous type.

Briefly stating this recording system, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head. In this way, this recording system is extremely effective to particularly the on-demand type recording method, because the bubbles within the liquid (ink) can be formed corresponding one by one to the driving signals issued to the electricity-heat converters. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, the recording heads to which the present invention is effectively applicable include a recording head of the full line type having a length corresponding to the maximum width of a recording sheet (recording medium) which can be recorded by the recording device. This full-line recording head may take either the constitution which satisfies its length by a combination of a plurality of recording heads as disclosed in the above-described specifications or the constitution as a single full-line recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

Though liquid ink is used in the embodiments of the present invention as above described, the present invention is also effective with the ink which is either solid or liquid at room temperatures. It is only necessary that the ink will liquefy when a recording start signal is issued as it is common with the ink jet device to control the viscosity of ink to be maintained within a certain range of the stable discharge by adjusting the temperature of ink in a range from 30° C. to 70° C.

In addition, it is possible to positively utilize the heat energy as the energy for the change of state from solid to liquid in order to avoid the excessive ink temperature elevation due to heat energy by, or to use the ink which will stiffen in the shelf state to prevent the evaporation of ink. In any case, the use of the ink having a property of liquefying only with the application of heat energy, such as liquefying with the application of heat energy in accordance with a recording signal so that liquid ink is discharged, or may solidify prior to reaching a recording medium, is also applicable in the present invention.

Such ink may be held as liquid or solid in recesses or through holes of porous sheet, which is placed opposed to electricity-heat converters, as described in Japanese Laid-Open Patent Application No. 54-56847 or No. 60-71260.

The most effective method for the ink as above described in the present invention is based on the film boiling.

What is claimed is:

1. A method for fabricating a liquid jet recording head having a base containing heat acting portions, liquid channels aligned over said heat acting portions and communicating to orifices for liquid discharge and a top plate covering said liquid channels, said method comprising the steps of (a) forming said base containing heat acting portions by a method comprising the steps of: (i) forming a heat generating resistive layer over a substrate: (ii) forming an electrode layer over said heat generating resistive layer; (iii) wet etching said electrode layer to form pairs of electrodes, wherein a wet etching rate is higher on an upper portion of said electrode layer in a direction of a film thickness of said electrode layer than on a lower portion of said electrode layer; and (iv) covering said pairs of electrodes with at least one protective covering layer;

(b) forming said liquid channels communicating to said orifices for liquid discharge over said heat acting portions on said base; and (c) covering said liquid channels with a top plate.

2. The method for fabricating a liquid jet recording head according to claim 1, wherein said electrode layer is composed of a material containing impurities.

3. The method for fabricating a liquid jet recording head according to claim 2, wherein the content of impurities in said material containing impurities is greater on the lower portion than on the upper portion.

4. The method for fabricating a liquid jet recording head according to claim 1, wherein the material of said electrode layer is homogeneous, and the film formation condition of said electrode layer is selected so that the etching rate is higher on the upper portion of said electrode layer than on the lower portion thereof.

5. A method for fabricating a base containing heat acting portions for a liquid jet recording head, said method comprising the steps of: (i) forming a heat generating resistive layer over a substrate; (ii) forming an electrode layer over said heat generating resistive layer; (iii) wet etching said electrode layer to form pairs of electrodes, wherein a wet etching rate is higher on an upper portion of said electrode layer in a direction of a film thickness of said electrode layer than on a lower portion of said electrode layer; and (iv) covering said pairs of electrodes with at least one protective layer.

* * * * *

UNITED STATES PATENT AND TRADEMARK OFFICE

CERTIFICATE OF CORRECTION

PATENT NO. : 5,439,554
DATED : August 8, 1995
INVENTOR(S) : Hideo Tamura, et al.

It is certified that error appears in the above-indentified patent and that said Letters Patent is hereby corrected as shown below:

ON TITLE PAGE

In [56] References Cited, under U.S. PATENT DOCUMENTS:

"4,459,600 7/1982 Sato et al." should read --4,459,600 7/1984 Sato et al.--.

COLUMN 2

Line 56, "propose" should read --proposal--.

COLUMN 3

Line 46, "ross" should read --cross--.

COLUMN 5

Line 18, "form" should read --from--.
Line 20, "There" should read --These--.

COLUMN 6

Line 7, "dry" should read --wet--.

COLUMN 7

Line 33, "format:ion" should read --formation--.
Line 47, "Layer" should read --layer--.

UNITED STATES PATENT AND TRADEMARK OFFICE

CERTIFICATE OF CORRECTION

PATENT NO. : 5,439,554

DATED : August 8, 1995

INVENTOR(S) : Hideo Tamura, et al.

It is certified that error appears in the above-indentified patent and that said Letters Patent is hereby corrected as shown below:

COLUMN 8

Line 17, "rate" should read --rates--.

COLUMN 9

Line 63, "10 For" should read --¶ For--.
Line 65, "bastard" should read --mixed--.

COLUMN 11

Line 6, "10 For" should read --¶ For--.

COLUMN 12

Line 63, "was" should read --was a--.

COLUMN 15

Line 24, "containing-a" should read --containing a--.

UNITED STATES PATENT AND TRADEMARK OFFICE

CERTIFICATE OF CORRECTION

PATENT NO. : 5,439,554

DATED : August 8, 1995

INVENTOR(S) : Hideo Tamure, et al.

It is certified that error appears in the above-indentified patent and that said Letters Patent is hereby corrected as shown below:

COLUMN 18

Line 6, "of" should read --of:--.
Line 9, "substrate:" should read --substrate;--.

Signed and Sealed this

Ninth Day of January, 1996

Bruce Lehman

*Attest:*

BRUCE LEHMAN

*Attesting Officer*

*Commissioner of Patents and Trademarks*